United States Patent [19]

Girard

[11] Patent Number: 4,598,561

[45] Date of Patent: Jul. 8, 1986

[54] SKI LOCKING DEVICE

[76] Inventor: Donald A. Girard, P.O. Box 172, Rancho Cordova, Calif. 95670

[21] Appl. No.: 740,647

[22] Filed: Jun. 3, 1985

[51] Int. Cl.[4] ..... E05B 73/00

[52] U.S. Cl. ..... 70/58; 70/19

[58] Field of Search ..... 70/14, 15, 18, 19, 57, 70/58, 39; 211/60 SK; 224/917; 286/623

[56] References Cited

U.S. PATENT DOCUMENTS

| | | | |
|---|---|---|---|
| 1,329,784 | 2/1920 | Lundin | 70/58 |
| 2,508,302 | 5/1950 | Stue | 70/19 |
| 2,700,289 | 1/1955 | Morgan | 70/14 |
| 2,720,102 | 10/1955 | Spain | 70/14 |
| 2,738,113 | 3/1956 | Sigler | 224/45 |
| 3,429,152 | 2/1969 | Whitaker et al. | 70/58 |
| 3,461,696 | 8/1969 | Seka | 70/58 |
| 3,504,405 | 4/1970 | Elliot-Smith | 24/81 |
| 3,636,739 | 1/1972 | Smedley | 70/58 |
| 3,739,606 | 6/1973 | Pyzel | 70/58 |
| 3,962,893 | 1/1976 | Anderson | 70/19 |
| 4,020,661 | 5/1977 | Rich | 70/58 |
| 4,057,983 | 11/1977 | Morgan | 70/18 |
| 4,144,728 | 3/1979 | Boynton | 70/58 |
| 4,171,079 | 5/1978 | Dietlein et al. | 224/45 |
| 4,216,665 | 8/1980 | McKelvey | 70/58 |

FOREIGN PATENT DOCUMENTS

| | | | |
|---|---|---|---|
| 608990 | 11/1960 | Canada . | |
| 869255 | 4/1971 | Canada | 70/6 |

*Primary Examiner*—Robert L. Wolfe

*Attorney, Agent, or Firm*—Owen, Wickerhsham & Erickson

[57] ABSTRACT

A portable ski locking device which secures a pair of skis or skis and poles together in a crossed-tip configuration. The ski-lock comprises a pad-lock type body with a securing mechanism and U-shaped rod similar to a common bicycle lock. The U-shaped rod has a tongue member attached with a circular eyelet. This ski-locking device secures a pair of skis or skis and poles together to thwart would be thieves by presenting an unwieldy and awkward combination.

10 Claims, 11 Drawing Figures

FIG. 1
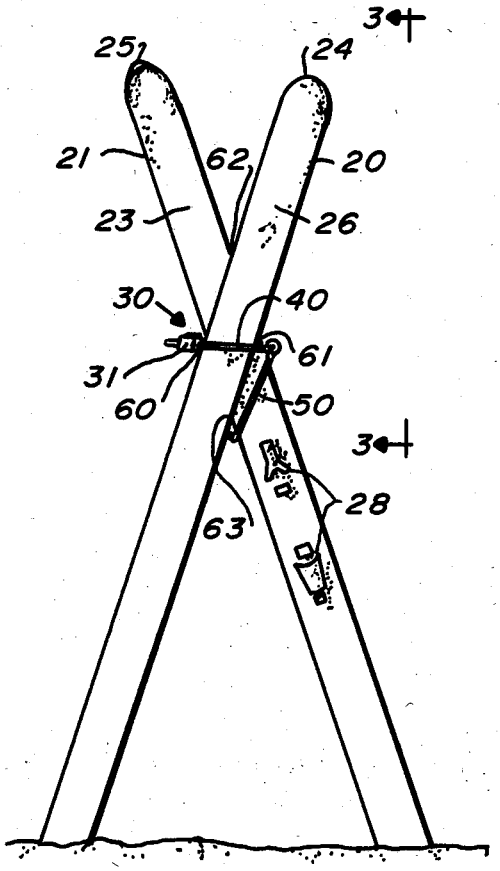
FIG. 2
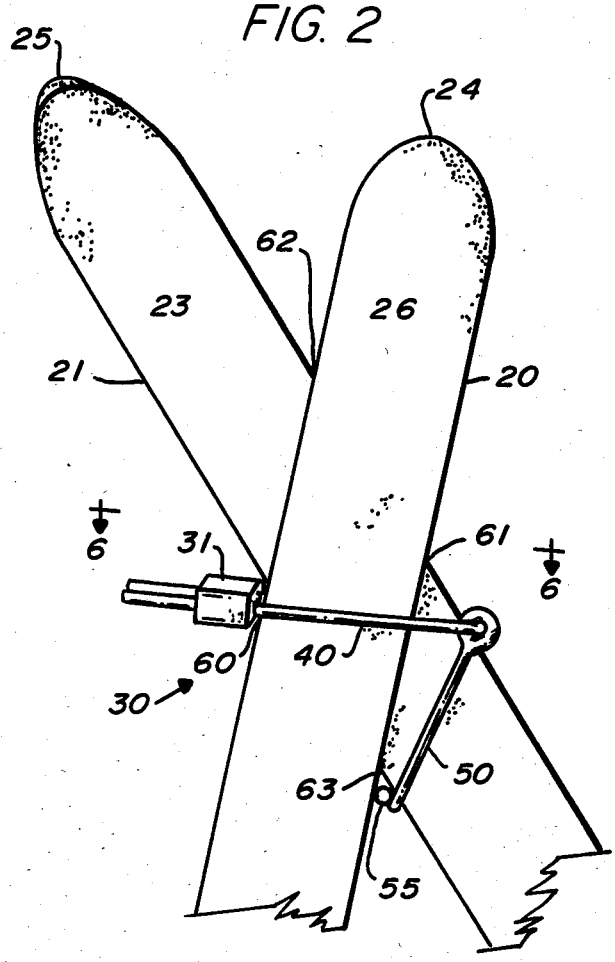
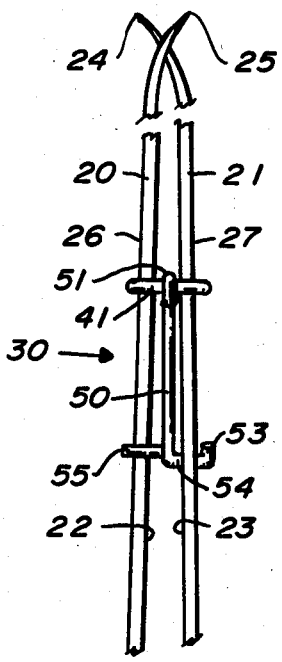
FIG. 3
FIG. 6
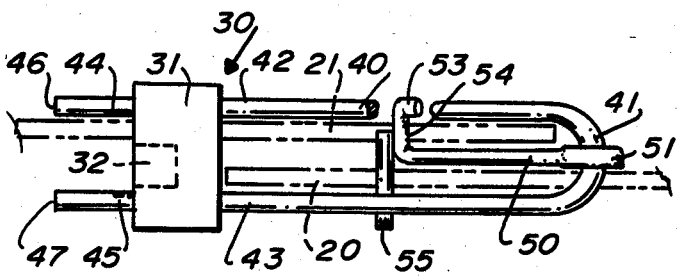

FIG. 4
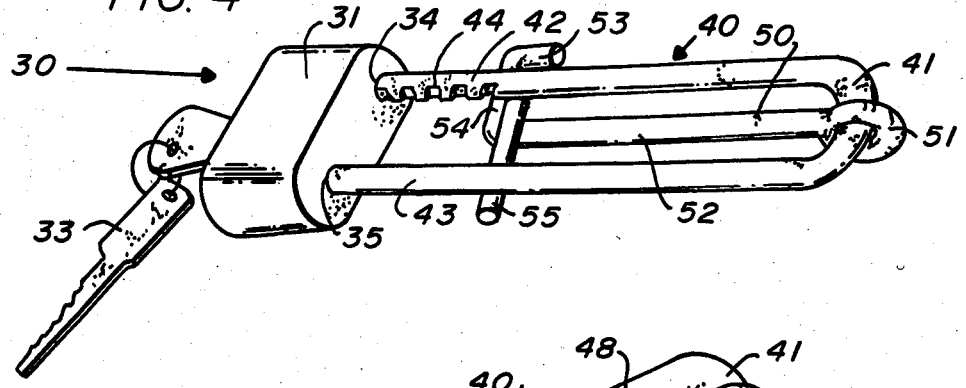
FIG. 5
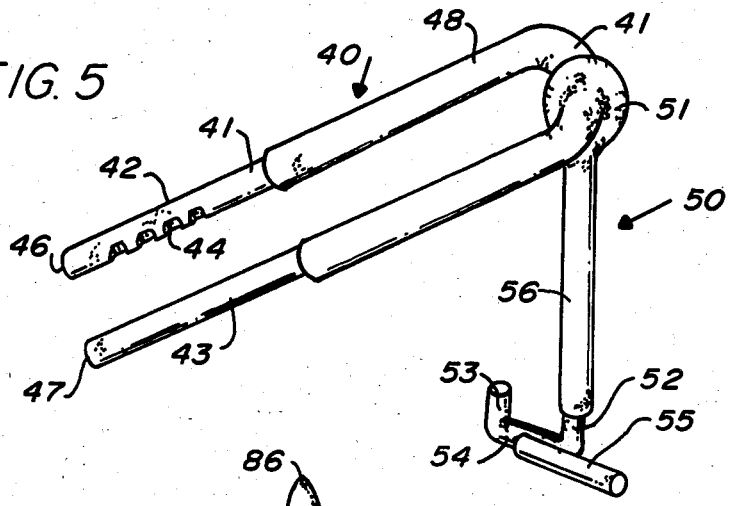
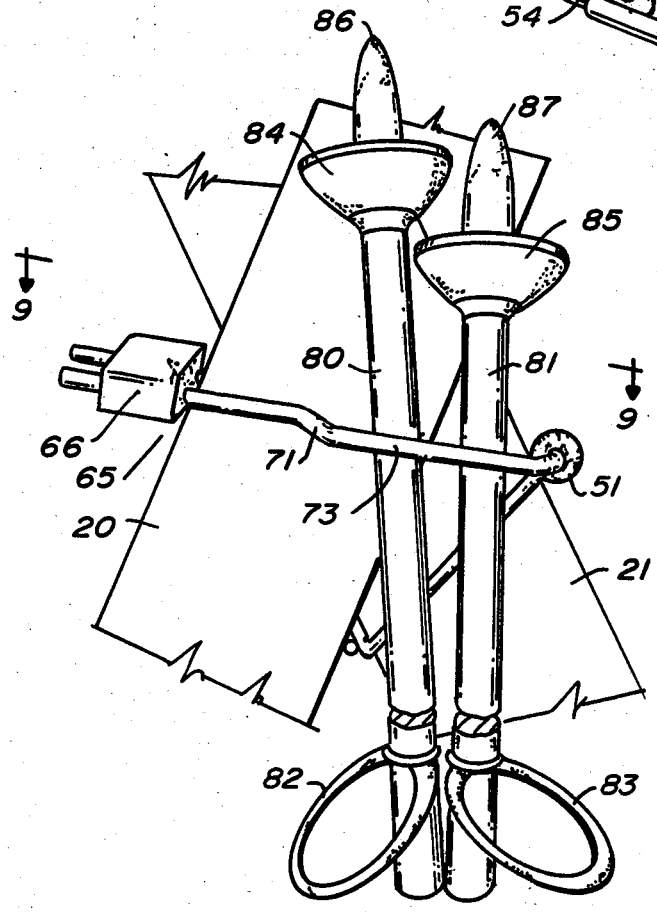
FIG. 8

SKI LOCKING DEVICE

This invention relates to a ski locking device.

BACKGROUND OF THE INVENTION

Skis are frequently stolen when they have been placed in the snow outside a ski area lodge and while the owners are inside. Rack locks are common in most ski areas, but often they are full, so that a person coming late has no place on the rack to put his skis. Moreover, racks are often broken, and even when in reasonably good condition, they are undependable and difficult to utilize, since the skis must be lifted up and fitted into very small compartments.

Several types of small portable ski locks presently on the market depend on a tethered cable for attaching the skis to a stationary object. Sometimes such stationary objects are not ones to which they can be attached, or there are simply none in the area.

An object of the invention is to provide a simple ski lock which can be carried in one's pocket and can be used at any time to lock a pair of skis together.

Another object is to provide a portable ski locking device which does not depend on any rack or cable or any member to attach a cable to, or any other thing except the skis themselves.

In this connection it may be said that while it might be possible to take a pair of locked skis, even as they are presented in this invention, and walk away with them, they would be very unwieldy and very visible, and anyone who did that would be readily detected and caught.

Therefore, another object of the invention is to fasten the skis together in such a manner that they become extremely cumbersome and unwieldy, so that a thief would attract a lot of attention trying awkwardly to carry such an ungainly burden away from a ski lodge or into it.

Another object of the invention is to render the locked skis extremely inconvenient and substantially impossible to attach to a ski rack on an automobile, and very difficult, if not impossible, to load into a van or pickup truck.

SUMMARY OF THE INVENTION

The ski lock itself comprises a padlock type of body with a securing mechanism, such as a locking cylinder, and a pair of shackle-receiving openings through the body, each opening having ratchet engaging members. Another principal part of the lock is a shackle, comprising an elongated U-shaped rod with a U-bowl at one end and a series of locking ratchets on each arm of the rod near the other end, providing two ratcheted arms which are intended to be passed through the openings of the body. Finally, there is a tongue or latch member with an eye at one end that encircles the U-bowl, so that the tongue or latch member can swing or pivot with respect to the rod. This latch or tongue member preferably has a U-shaped hook at a distal end, somewhat like a gate hook, and it also has a short bar which is secured rigidly to the tongue member at a locus near where the hook begins.

In employing the method of the invention, the skis are crossed over near the front end in a manner such that the up-curved, front end portions or shovels face each other; in other words the upper surfaces of the two skis face each other. The crossover is well to the forward end of the ski, and spaced well forward of the ski bindings.

With the skis thus crossed over, the body of the padlock member is placed to engage one side of one of the skis near one of the two vertices transverse to the crossover. The shackle is then positioned so that the U-bowl engages the distal side of the other ski near the opposite vertex, while the U-shaped hook is placed to engage the near side of that same ski at the vertex in between the skis, and the rod member engages the other ski. Then the two rod portions of the shackle are inserted into the body openings and pushed through to bring the U-bowl as close to the body as possible. Finally the securing mechanism if not self locking, is locked.

To retrieve the skis, all that need be done is to unlock the securing mechanism and detach the body from the shackle.

However, so long as the skis are locked, they will remain in this crossed position, because it is not possible to move the skis into any position where they can be taken out from between the locks so long as the shackle rods are properly close together, and they should, when locked, engage the opposite sides of the two skis. If one attempts to slide either ski forward, the curved-up forward ends or shovels of the skis will limit and soon prevent any such relative movement, even if they were not already located in a position preventing that. If one attempts to move a ski in the opposite direction, the increased thickness of each ski as one goes from the front end to the bindings very soon prevents further relative movement. Even if one were to remove the bindings from the skis, the increase in thickness of the skis toward the binding platform would prevent the removal of the skis from the lock. It is true that the width of the ski narrows somewhat towards the binding, but not sufficiently to overcome the effect of the ski thickness, and when the two shackle rods are properly made, the thickness of the skis is the ruling factor.

Ski poles may also be locked to the skis in some forms of the invention. The operation is substantially the same, and the shackle structure prevents withdrawal of the ski poles, which have enlargements near each end.

Other objects, advantageous, and features of the invention will appear from the following description.

BRIEF DESCRIPTION OF THE DRAWINGS

FIG. 1 is a view in elevation of a pair of crossed-over skis locked together according to the principles of the invention.

FIG. 2 is a fragmentary view in front elevation of the upper part of the crossed-over skis of FIG. 1 showing more clearly the lock in place that secures this pair of skis together.

FIG. 3 is a fragmentary view in side elevation looking along the line 3—3 in FIG. 1.

FIG. 4 is a view in perspective of the ski-lock apparatus of FIGS. 1 and 2, shown without the elastomeric cover.

FIG. 5 is a perspective view of the U-shaped shackle and tongue member of the ski lock shown in FIG. 1, with the elastomeric cover.

FIG. 6 is a view in section taken along the line 6—6 in FIG. 2, with a portion of the shackle broken away and the skis shown in broken lines.

FIG. 8 is a fragmentary view in front elevation of a lock having a shackle as shown in FIG. 7 locked in place and securing a pair of skis and also a pair of skis poles together.

DESCRIPTION OF A PREFERRED EMBODIMENT

Figure 9:
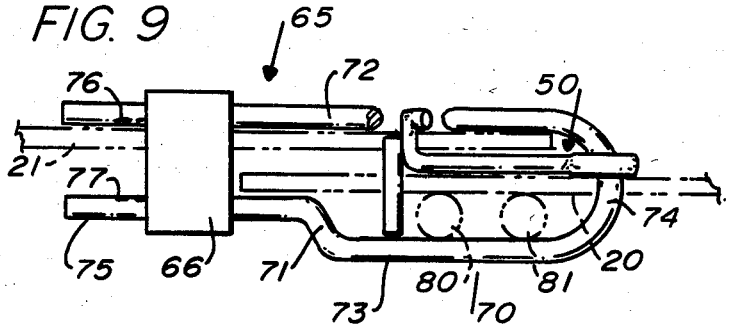
FIG. 9 is a view in section taken along the line 9—9 in FIG. 8, with the shackle broken in part and with skis and poles shown in broken lines.

As shown in FIGS. 1-3, a basic principle of the invention is that a pair of skis 20 and 21 are placed face-to-face with their respective upper surfaces 22 and 23 facing each other and their front ends or shovels 24 and 25 curled up to overlap the planes of the opposite ski. The ground-engaging surfaces 26 and 27 face away from each other, and the cross-over is between the front ends 24, 25 and the ski bindings 28. Then a lock 30 is applied at the cross-over point, in the manner shown and as described later.

The owner can then simply stand the skis up in the snow, as in FIG. 1, or lean them against a building or tree, secure in his knowledge that anyone attempting to steal the skis will have a most difficult time of not making a spectacle of himself, and for that reason very unlikely to attempt the theft. Anyone knowing anything about the ski lock of this type and seeing someone walking away or during any walk the crossed-over skis would immediately assume that the person is a thief, and would attract attention to him.

When the owner of the skis 20 and 21 returns, and desires either to put the skis back on or to carry them away, he simply unlocks the lock 30, removes the lock from the skis and sticks it in his pocket, and then places the skis 20 and 21 into a normal position for carrying, where they are nested, or puts them on.

As shown in FIG. 4 the locking device 30 itself comprises a padlock type of body 31, with a securing mechanism such as a locking cylinder 32 (See FIG. 6), and it may be operated by a key 33 or by a combination device (not shown). The body 31 includes a pair of shackle receiving openings 34 and 35, each having conventional ratchet engaging members inside.

As FIG. 5 shows, the lock 30 also comprises a shackle 40, comprising an elongated U-shaped rod with a U-bowl 41 at one end, and a pair of elongated rod portions 42 and 43 meeting there. Each rod portion 42, 43 has a series of locking ratchets 44, 45 nearer its free end 46, 47, which is to engage the body 31. Except for the end portion and the ratchets 44, and 45, the shackle 40 is preferably encased in a yieldable elastomeric cover 48, such as a yielding elastomeric tube (See FIG. 5).

A tongue or latch member 50 has an eye 51 at one end, encircling the U-bowl portion 42 of the shackle 40, so that it can swing relatively freely with respect to the shackle 40. From the eye 51 a shank 52 leads by a substantially transverse portion 54 to a U-shaped hook 53, formed from the same rod-like tongue member 50. The hook 53 extends back toward the eye 51, and is sufficiently long so that is cannot easily be loosened when the device is locked in place. Further, a short bar member 55 is secured rigidly to the tongue member 50 at a point on the shank 52 near where the hook 53 begins. The eye portion 51 and the shank 52 are preferably encased in an elastomeric tube 56 that is integral with the tube 48.

To accomplish the locking, the skis 20 and 21 are crossed over with their upper surfaces 22 and 23 facing or even resting against each other and their upcurved forward ends 24 and 25 therefore facing each other. See FIGS. 1-3. The crossover forms four vertices 60, 61, 62 and 63, two transverse vertices 60 and 61 and two longitudinal vertices 62 and 63, as viewed with respect to the skis 20 and 21. The padlock body 31 is then placed into one transverse vertex 60 to engage one ski 20. Next the U-shaped shackle 40 is placed so that its U-bowl 42 engages the opposite ski 21 in the opposite vertex 61. With the skis 20 and 21 in this position, the tongue or latch 50 is easily secured to that same ski 21, while the bar 55 engages the opposite ski 20. The shackle 40 and the body 31 are then assembled together, with the shackle rod portions 42 and 43 extending through the openings 34 and 35, respectively, and the ratchet-engaging members (not shown) inside the lock body 31 engage the ratchets 44 and 45 of the rod portions 42 and 43.

The lock 30 may be one of the self-locking types that automatically engages on any tooth of the ratchet 44 or 45 when the body 31 and the shackle 40 are forced together, so that they are as close as they can be brought, and with the tongue or latch 50 engaging the skis 20 and 21 as stated. If the lock 30 is not self-locking, it is, of course, at that point, locked with a key 33 or by scrambling a combination assembly.

The yieldable elastomeric tube 48 and the tongue covering portion 56, which are preferably integral, provide a yieldable surface that can accommodate toleranaces in the actual thickness and width of the skis 20 and 21 and enable the accommodation to minor variations in size at those points. If these parts be omitted, the sizes may have to be made somewhat more accurately. The covering members 48 and 56 also serve to protect the ski surface from scratching or other damage by the metal parts.

Figure 7:
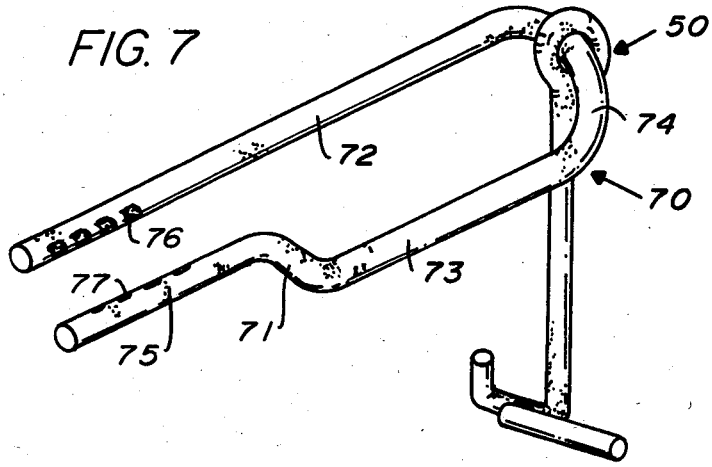
FIG. 7 is a perspective view of a modified form of shackle embodying the principles of the invention with the tongue member of the ski lock hanging loosely from the shackle.

Another form of lock 65 is shown in FIGS. 7-9. Its body 66 may be like the body 31, but a somewhat different shackle 70 is shown. The main difference in the shackle 70 is an offset 71 in one of the two arms or rod-like portions 72 and 73. This means that going from its U-bowl portion 74, that portion of the arm 73 is distant from the opposite arm 72 until it reaches the offset 71, which leads to a nearer portion 75, also parallel with the arm 72. On the portions 72 and 75 are ratchet teeth 76 and 77. In this form of the invention it is not necessary to have the rubber or elastomer covering, although that may still be used. This structure enables the user to clamp in a pair of ski poles 80 and 81, the clamping being done around their main portions. Since they are wider at the bottom of FIG. 8 at their straps 82 and 83 and are also wider at the top of FIG. 8, at the stop members 84 and 85 near pointed ends 86 and 87, they cannot be extracted either. FIG. 8 shows how everything is held together, and FIG. 9 also illustrates the way in which the lock bears on the skis and ski poles.

Figure 10:
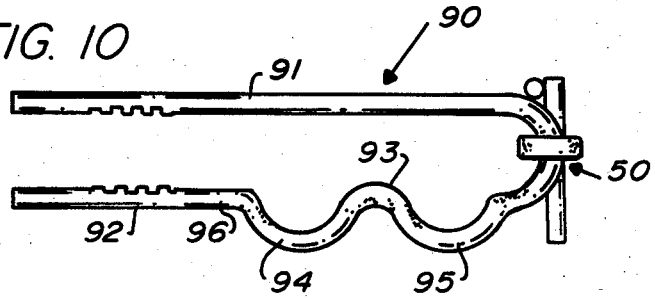
FIG. 10 is a view from above of a modified form of shackle embodying the principles of the invention, the tongue member of the ski lock hanging vertically from the shackle.

FIG. 10 shows another similar form of lock with a modified form of shackle 90. Here, one of the two rod-like portions 91 of the shackle 90 is straight, while the other one 92 is provided with an inwardly projecting portion 93 in between two outwardly projecting portions 94 and 95. The portion 93 and an end portion 96 enable contact against the skis, while the portion 94 and 95 provide spaces where, if desired, the ski rods 80 and 81 may be inserted.

Figure 11:
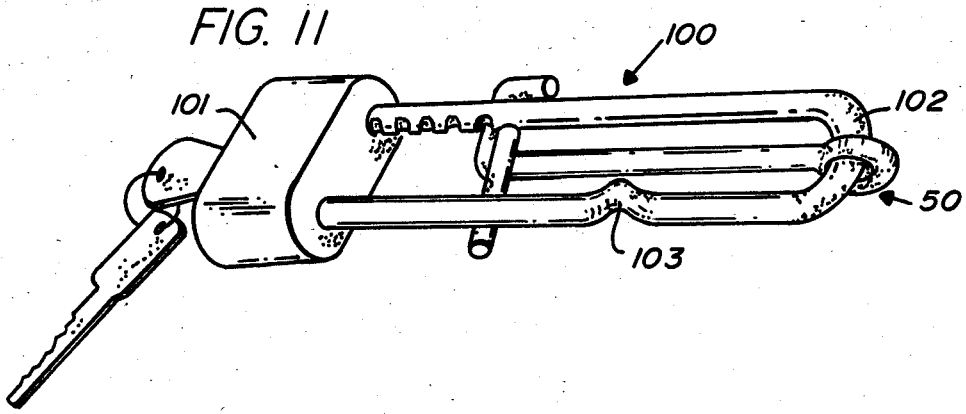
FIG. 11 is a view in perspective of a lock incorporating the shackle of FIG. 10.

FIG. 11 shows a lock 100 with the lock body 101 as before but with a shackle 102 having one inwardly projecting portion 103 for engaging the skis snugly.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A ski-locking device for use with a pair of crossed-over skis with their upper surfaces and the upcurved portions of their forward ends facing each other, the crossover being near the upcurved forward ends and well forward of the ski bindings, comprising a padlock-type of body with a securing mechanism and a pair of shackle-receiving openings therethrough having ratchet engaging members, a shackle comprising an elongated U-shaped rod with a U-bowl at one end and a series of locking ratchets near the other end of each of two elongated rod portions, which pass through said openings for securement by said securing mechanism and body, and a tongue member with an eye at one end encircling said rod at said U-bowl to enable swinging movement with respect to said rod and a U-shaped hook at a distal end, and a short bar secured rigidly to the tongue member near where said hook begins, whereby with the skis crossed over, the body engages at least one side of said ski close to one of the two vertices transverse to the crossover, and the U-bowl engages the distal side of the other said ski near the opposite vertex, the U-shaped hook engages the near side of that same said other ski at the vertex between the skis, and the bar engages the other ski, with the two shackle rod portions in contact with both skis along their normally bottom surface, so that the skis can neither be slid along nor rotated to a position where either can be removed from the lock, due partly to the orientations of their upturned end portions and to their thickening toward their bindings, and partly to the distance apart of the shackle rods and their length from the U-bowl to the body and to the length of the tongue member.

2. The ski locking device of claim 1 wherein said shackle can accomodate both a pair of skis and a pair of ski poles.

3. The ski-locking device of claim 2, wherein said shackle is too narrow for the skis and poles to be slipped apart and removed from the device, while being wide enough to enable their easy installation.

4. The ski-locking device of claim 1 wherein said shackle is wide enough to enable easy installation about a pair of skis and a pair of ski poles, but is too narrow for the skis or poles to be removed from the locked device.

5. The ski locking device of claim 1 wherein said shackle and tongue member are mostly covered with a yielding elastomeric material.

6. The ski locking device of claim 1 wherein said shackle has two lateral bulges to accomodate a pair of ski poles.

7. The device of claim 1 wherein the shackle has one rod portion provided with an offset portion, so that the space between the two rod portions near the U-bowl is wide enough to accommodate a pair of ski poles between the offset rod portion and the skis.

8. The device of claim 1 wherein one rod portion of the shackle is provided with an inwardly projecting portion for snugly engaging one said ski.

9. A method for locking together a pair of skis having upper surfaces with upcurved front end portions and bindings to the rear thereof, comprising crossing over the skis near their front ends with the front ends and the upper surfaces facing each other, placing a padlock-type of body having a securing mechanism and a pair of shackle-receiving openings therethrough, to engage one side of one said ski near one of the two vertices transverse to the crossover, placing a shackle comprising an elongated U-shaped rod with a U-bowl at one end a series of locking ratchets at the other end of each of two elongated rod portions so that said U-bowl engages the distal side of the other said ski near the opposite vertex, placing a tongue member with an eye at one end encircling said rod at said U-bowl for swinging movement with respect to said rod and a U-shaped hook at the other end, so that the U-shaped hook engages the near side of that same said other ski at the vertex between the skis, inserting the two rod portions through the body openings and bringing the U-bowl as close to the body as possible, and locking said securing mechanism.

10. The method of claim 9 wherein the shackle has at least one portion, on one rod portion, near said U-bowl, that is spaced apart from the other rod portion further than the remainder of the former-named rod portion, enabling inserting a pair of ski poles between that rod portion and one of the skis during said step of placing the shackle.

* * * * *